US008453732B2

(12) United States Patent
Sonne et al.

(10) Patent No.: US 8,453,732 B2
(45) **Date of Patent: *Jun. 4, 2013**

(54) APPARATUS TO SAMPLE HEAVY OIL FROM A SUBTERRANEAN FORMATION

(75) Inventors: Carsten Sonne, Birkerod (DK); Peter S. Hegeman, Stafford, TX (US); Anthony R. H. Goodwin, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/754,334

(22) Filed: Apr. 5, 2010

(65) Prior Publication Data

US 2010/0186948 A1 Jul. 29, 2010

Related U.S. Application Data

(62) Division of application No. 11/755,039, filed on May 30, 2007, now Pat. No. 7,717,172.

(51) Int. Cl.
*E21B 47/00* (2006.01)
*E21B 49/08* (2006.01)

(52) U.S. Cl.
USPC ..... 166/264; 166/302; 166/57; 166/60; 73/152.13; 175/59

(58) Field of Classification Search
USPC ..... 166/264, 302, 57, 60; 175/59; 73/152.13, 73/152.12
See application file for complete search history.

(56) References Cited

U.S. PATENT DOCUMENTS

| | | | | |
|---|---|---|---|---|
| 3,713,488 | A | | 1/1973 | Ellenburg |
| 4,137,970 | A | | 2/1979 | Laflin et al. |
| 4,745,802 | A | * | 5/1988 | Purfurst ..... 73/152.26 |
| 4,766,955 | A | | 8/1988 | Petermann |
| 4,860,581 | A | | 8/1989 | Zimmerman et al. |
| 4,881,406 | A | | 11/1989 | Coury |
| 4,936,139 | A | | 6/1990 | Zimmerman et al. |

(Continued)

FOREIGN PATENT DOCUMENTS

| | | | |
|---|---|---|---|
| GB | 2431673 | | 5/2007 |
| WO | WO02057596 | | 7/2002 |
| WO | WO03016826 | | 2/2003 |
| WO | WO2007/048991 | * | 5/2007 |

OTHER PUBLICATIONS

Meyer, R.F. et al., Natural Bitumen and Extra Heavy Oil, Ch. 4, 2004, Survey of Energy Resources, J. Trinnaman and A. Clarke Eds. for the World Energy Council, Elsevier, Amsterdam, 2004, p. 93-117.
Heron, J.J. et al., Ann. Rev, Energy 1983, 8, 137-163.

(Continued)

*Primary Examiner* — Cathleen Hutchins
(74) *Attorney, Agent, or Firm* — John Vereb

(57) ABSTRACT

A method of sampling fluid from a subterranean formation includes positioning a first tool having a heater in a borehole so that the heater is adjacent a portion of the subterranean formation; heating with the heater the portion of the subterranean formation; removing the first tool from the borehole; orienting a second tool having a sampling probe in the borehole so that the sampling probe is to contact a portion of the subterranean formation heated by the heater; and obtaining via the sampling probe a fluid sample from the portion of the subterranean formation heated by the heater.

11 Claims, 7 Drawing Sheets

U.S. PATENT DOCUMENTS

| | | | | |
|---|---|---|---|---|
| 5,302,781 | A | | 4/1994 | Hanson, III |
| 5,353,637 | A | * | 10/1994 | Plumb et al. ..... 73/152.17 |
| 5,494,106 | A | | 2/1996 | Gueguen et al. |
| 5,902,939 | A | | 5/1999 | Ballard et al. |
| 6,343,652 | B1 | | 2/2002 | Corre et al. |
| 6,786,086 | B2 | | 9/2004 | Hashem |
| 6,914,804 | B2 | | 7/2005 | Leslea |
| 7,252,142 | B2 | | 8/2007 | Brezinski et al. |
| 2003/0226663 | A1 | | 12/2003 | Krueger et al. |
| 2004/0089475 | A1 | | 5/2004 | Kruspe et al. |
| 2007/0215348 | A1 | | 9/2007 | Corre et al. |

OTHER PUBLICATIONS

Oblad, A.G. et al., Ann. Rev. Energy 1987, 12, 283-356.
Speight, J.G., Ann. Rev. Energy 1986, 11, 253-274.
Ovalles, C., Fuel 1995, 74, 1162-1168.

* cited by examiner

APPARATUS TO SAMPLE HEAVY OIL FROM A SUBTERRANEAN FORMATION

CROSS-REFERENCE TO RELATED APPLICATIONS

The present Application is a divisional of U.S. patent application Ser. No. 11/755,039, filed May 30, 2007, the entire disclosure of which is hereby incorporated herein.

FIELD OF THE DISCLOSURE

The present disclosure relates generally to sampling formation fluids and, more particularly, to methods and apparatus to sample heavy oil from a subterranean formation.

BACKGROUND

Shallow subterranean hydrocarbon-bearing formations, which are typically at a depth of less than one thousand meters from the surface often contain heavy oil. The temperatures and hydrostatic pressures associated with these shallow formations are often less than 100° C. and 30 MPa, respectively. The United States Geological Survey (USGS) categorizes heavy oil based on the density and viscosity of the fluid. In particular, according to the USGS, medium heavy oil exhibits a density of 903 to 946 kg/m$^3$ that corresponds with an API gravity of 25 to 18, and a viscosity from 10 to 100 mPa·s. Such medium heavy oil is typically mobile at reservoir conditions. Also, according to the USGS, extra heavy oil exhibits a density of 944 to 1021 kg/m$^3$ that corresponds with an API gravity of 20 to 7, and a viscosity from 100 to 10,000 mPa·s. Such extra heavy oil is also typically mobile at reservoir conditions. The viscosity of heavy oil, such as those mentioned above, in combination with the permeability of the formation containing the heavy oil, determines the mobility of the heavy oil. In turn, the mobility of the heavy oil can impact significantly the techniques needed to sample and produce the heavy oil from the formation.

When sampling a heavy oil from a formation, it is desirable and often required that the sample is chemically representative (i.e., representative of the constituents and mole fractions) of the fluid in the formation from which the sample is extracted. Thus, the sample is preferably substantially free of contaminants such as drilling fluid or filtrate, and otherwise substantially chemically unaltered by the sampling process. A sample that represents accurately the characteristics of the fluid in the formation enables a suitable production strategy to be determined. However, sampling processes can, and often do, cause non-reversible, significant changes to the hydrocarbon fluid sampled from a formation, thereby significantly increasing the difficulty of selecting an appropriate production strategy.

In practice, techniques for sampling formation fluid must typically contend with constraints related to fluid mobility, formation type, undesirable phase transitions, the formation of emulsions or other mixtures with other phases (e.g., connate water), etc. In the case of sampling heavy oil, the above-mentioned constraints are sometimes compounded because heavy oil is often found in unconsolidated (e.g., sand) formations and the heavy oil is often not sufficiently mobile to permit sampling using a sampler having a probe assembly that contacts a borehole wall. More specifically, sampler pumps typically provide a minimum pump fluid-flow rate of about 0.1 cm$^3$/s which, given the relatively low mobility of the heavy oil through the formation, can generate relatively large pressure drops that can result in the development of emulsions and/or collapse of the formation or a phase transition of the fluid.

SUMMARY

According to one embodiment of the disclosure, a method of sampling fluid from a subterranean formation is disclosed. The method includes positioning a first tool having a heater in a borehole so that the heater is adjacent a portion of the subterranean formation; heating with the heater the portion of the subterranean formation; removing the first tool from the borehole; orienting a second tool having a sampling probe in the borehole so that the sampling probe is to contact a portion of the subterranean formation heated by the heater; and obtaining via the sampling probe a fluid sample from the portion of the subterranean formation heated by the heater.

According to another embodiment of the disclosure, a system for heating and recovering heavy oil samples from a subterranean formation is disclosed. The system includes a first tool and a second tool. The first tool includes a heating module to convey heat energy to a portion of the subterranean formation and a heating control unit to control the heat energy provided by the heating module. The second tool includes a sampling inlet and an orientation module the orients the inlet relative to the portion of the subterranean formation.

According to another embodiment of the disclosure, a sampling tool for use in obtaining a fluid sample from a subterranean formation is disclosed. The tool includes an orientation module, at least one temperature sensor, and a sampling probe. The orientation module determines a position of the sampling tool in a borehole associated with the subterranean formation, and the temperature sensor senses a temperature of a wall of the borehole to identify a previously heated portion of the subterranean formation. The sampling probe obtains a sample of fluid from the previously heated portion of the subterranean formation.

DETAILED DESCRIPTION

Figure 1:
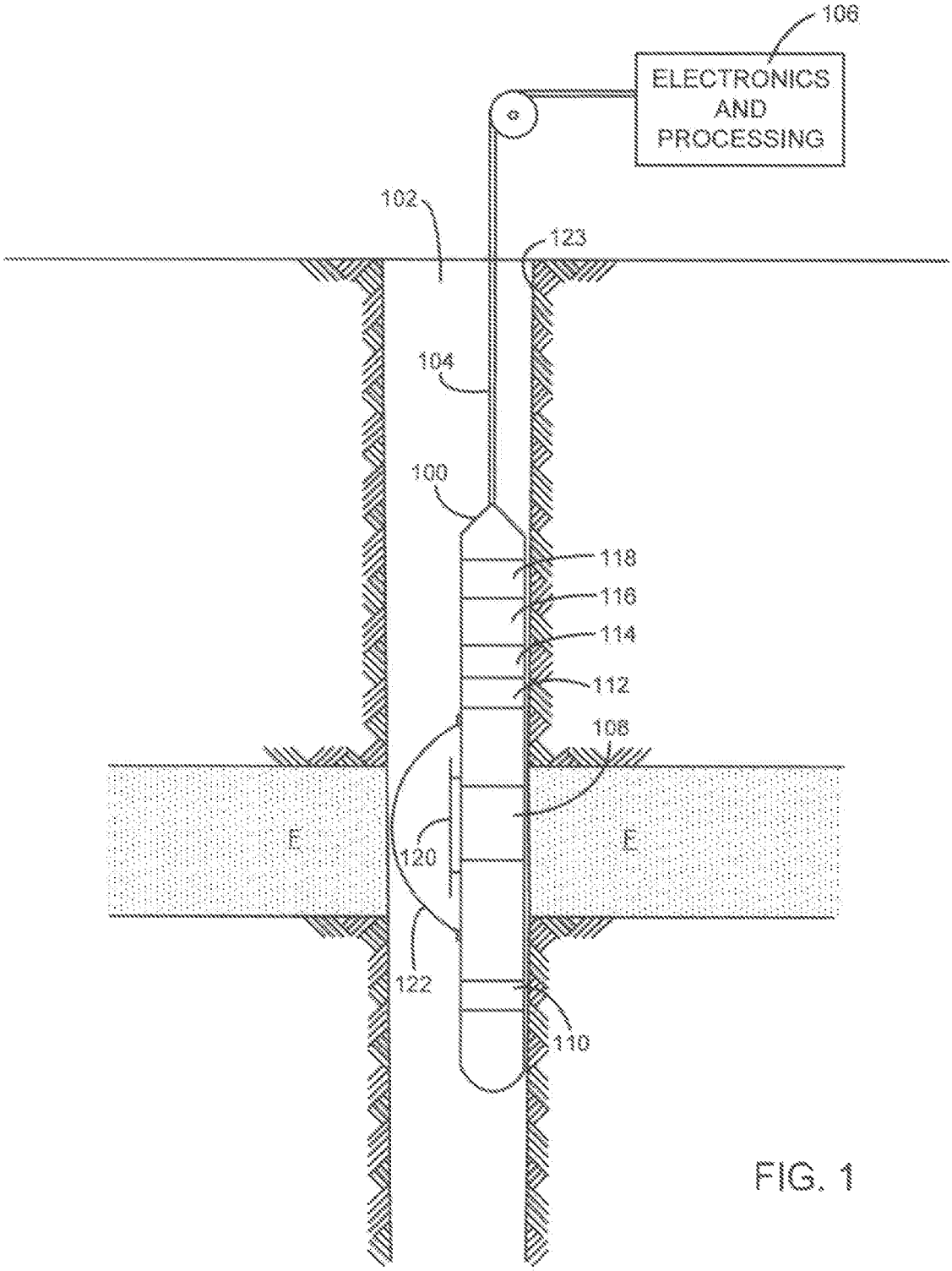
FIG. 1 depicts an example downhole formation heating tool that has been deployed into a wellbore or borehole to heat a portion of a subterranean formation from which a sample of a heavy oil is to be obtained.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

In general, the example methods and apparatus described herein may be used to facilitate the sampling of heavy oil from a subterranean formation. The term "heavy oil" as used throughout is not intended to limit the scope of the application, but for brevity reasons will be used to identify all variations of oils including heavy oil, medium heavy oil, extra heavy oil and bitumen. As described in greater detail below, the example methods and apparatus use a downhole tool having a heater to increase the temperature of a portion of a formation that decreases the viscosity of the fluid in the formation so it can be sampled with a formation tester. In particular, in the described examples, a portion of a downhole tool having a heater or heating unit is engaged against or near a borehole wall in an area associated with a formation from which sample fluid is to be obtained. The heater is held in contact with the borehole wall for a time sufficient to raise the temperature of a volume of the formation to decrease the viscosity of the fluid and, thus, increase the mobility of the fluid in the heated volume of the formation.

Once the formation has been sufficiently heated, the location within the borehole associated with the heated volume of the formation is determined or verified. For example, the depth and orientation of the heater and, thus, the heated portion of the formation is determined or verified and stored for later reference. The downhole tool providing the heater is then removed from the borehole and a sampling tool is placed in the borehole and located within the borehole so that the sampling probe(s) of the sampling tool are positioned to extract sample fluid from the previously heated volume of the formation. Pre-heating the sampling tool minimizes any cooling effect the tool may have on the fluid sampled and, thus, would facilitate the flow of sampled fluid within the sampling tool. Also, the sampling tool is preferably positioned using the earlier stored heater orientation information so that the sampling probe(s) can be positioned precisely at the depth and orientation that enables the probe(s) to contact the borehole wall in the area of formation that was previously heated. The sampling tool then extracts fluid from the heated portion or volume of the formation and, when the sampling is complete, the sampling tool can be retrieved to the surface to enable analysis of the sampled heavy oil. Alternatively, the fluid can be analyzed in the downhole tool, and thus not required to be brought to the surface.

The example methods and apparatus described herein provide a sampling process that does not permanently change the characteristics (i.e., the characteristics of the hydrocarbon) of the sample fluid. As a result, the example methods and apparatus can be used to obtain heavy oil samples that represent accurately the heavy oils in subterranean formations so that appropriate or optimal production strategies can be selected and employed to extract the heavy oils to the surface. One known sampling tool described in U.S. Pat. No. 6,941,804 uses a heating device located on or integral with the sampling tool (e.g., near the sampling probe) to heat the formation to facilitate sampling of heavy oil. However, in contrast to this known sampling device and other known methods and apparatus that provide only a heated sampling probe, the example methods and apparatus described herein decouple the formation heating and sampling systems (e.g., as two separate tools), thereby enabling more optimal control of the heating and sampling operations for formations containing heavy oil.

FIG. 1 depicts an example downhole formation heating tool 100 that has been deployed (e.g., lowered) into a wellbore or borehole 102 to heat a portion or volume of a subterranean formation F from which a sample of a heavy oil is to be obtained. The formation heating tool 100 is depicted as a wireline type tool and, thus, is lowered into the borehole 102 via a cable 104, which bears the weight of the formation heating tool 100 and which includes electrical wires or additional cables to convey power, control signals, information carrying signals, etc. between the formation heating tool 100 and an electronics and processing unit 106 on the surface adjacent the borehole 102.

The formation heating tool 100 includes a plurality of sections, modules, or portions commonly referred to as subs to perform various functions. More specifically, the formation heating tool 100 includes a heater section or heating module 108 that, as described in greater detail below, applies a controlled amount of heat energy (e.g., a controlled temperature for a predetermined time) to the formation F to heat a volume of the formation F from which a sample of heavy oil is to be extracted.

The formation heating tool 100 may also includes packers 110 and 112. One or both of the packers 110 and 112 may be used to remove borehole fluid (e.g., drilling fluid) from a portion of the borehole 102 to minimize or eliminate the conduction of heat away from an area of the formation F being heated by the heating module 108. For example, both of the packers 110 and 112 may be expanded to hydraulically isolate a section of the borehole occupied by the heating module 108. Thus, with the heating module 108 aligned with a section of the borehole 102 corresponding to the formation F, hydraulically isolating the heating module 108 also hydraulically isolates the portion of the formation F to be heated, thereby enabling the heating module 108 to deliver substantially all of its heat energy to the formation F. In other words, using one or both of the packers 110 and 112 to hydraulically isolate the area of the formation F to be heated minimizes or prevents the heat energy generated by the heating module 108 from being carried away to other portions of the borehole 102 via borehole fluid.

To extract borehole fluid from the area to be isolated by one or both of the packers 110 and 112, the heating tool 100 includes one or more pumping modules 114. The pumping module 114 may include one or more hydraulic motors, electric motors, valves, flowlines, etc. to enable borehole fluid to be removed from a selected area of the borehole 102 surrounding a portion of the heating tool 100.

To determine the location or position of the heating tool 100 in the borehole 102, the heating tool 100 includes a position detector 116. The position detector 116 may detect the depth and orientation (e.g., rotational or angular position) of the heating tool 100 within the borehole 102. The position detector 116 may be implemented using, for example, one or more magnetometers or the General Purpose Inclinometry Tool (GPIT™) provided by Schlumberger, Inc. Alternatively, the position detector 116 may be configured to provide only information relating to the orientation of the heating tool 100 and the depth of the heating tool 100 within the borehole 102 may instead be determined using any known method of determining depth such as, for example a gamma-ray device, cable flagging, or any other method of determining or measuring the length of the cable 104 extending from the surface into the borehole 102.

To convey power, communication signals, control signals, etc. between the surface (e.g., to/from the electronics and processing unit 106) and among the various sections or modules composing the heating tool 100, the heating tool 100 includes an electronics module 118. The electronics module 118 may, for example, be used to convey position information provided by the position detector 116 to the electronics and processing unit 106 to enable an operator and/or system on the surface to determine the location or position of the heating module 108 in the borehole 102. In particular, the position information may be used to align the heating module 108 with the formation F and, as described in more detail below, may subsequently be used to position a sampling tool and its sampling probe(s) in substantially the same location of the formation F previously heated by the heating module 108. The electronics 118 may also control the operation of the pumping module 114 in conjunction with operation of the packers 110 and/or 112 to, for example, hydraulically isolate a portion of the borehole 102 to facilitate heating of a portion of the formation F.

As depicted in FIG. 1, the heating tool 100 may also includes a heat reflector 120 and a bow spring 122. The heat reflector 120 is attached to a side of the heating tool 100 so that heat applied by the heating module 108 to a wall 123 of the borehole 102 is reflected and/or focused on the side of the heating tool 100 that is in contact with the portion of the formation F to be heated. The heat reflector 120 is preferably, but not necessarily, configured to have a curved shape that is complementary to the shape of the heating tool 100. Additionally, the heat reflector 120 may be sized to encircle about ninety degrees or more of the outer circumference of the heating tool 100 and to extend over at least the length of the heating module 108 portion of the heating tool 100. However, a variety of other geometries and/or sizes could be used to effectively reflect heat generated by the heating module 108 back onto the area of the borehole wall 123 being heated by the heating module 108. The bow spring 122 is positioned on the heating tool 100 adjacent the reflector 120 to orient the heating tool 100 against or in contact with the wall 123 of the borehole 102 and, thus, to cause the heating module 108 to engage or contact an area of the formation F to be heated. While the example heating tool 100 is depicted as having one bow spring 122, additional bow springs could be employed and/or different mechanisms or techniques could be employed to ensure that the heating module 108 engages or contacts the wall 123 of the borehole 102 in the area of the formation F. Further, while the example heating tool 100 is depicted as being deployed in the borehole 102 as a wireline device, the heating tool 100 could alternatively or additionally be deployed in a drill string, using coiled tubing, or by any other known method of deploying a tool into a borehole. Still further, the example heating tool 100 may be implemented by modifying one or more existing tools. For example, either or both of the Hydrate Melter™ and the PatchFlex™ products provided by Schlumberger, Inc. could be modified to provide the features and functions of the example heating tool 100 of FIG. 1.

Figure 2:
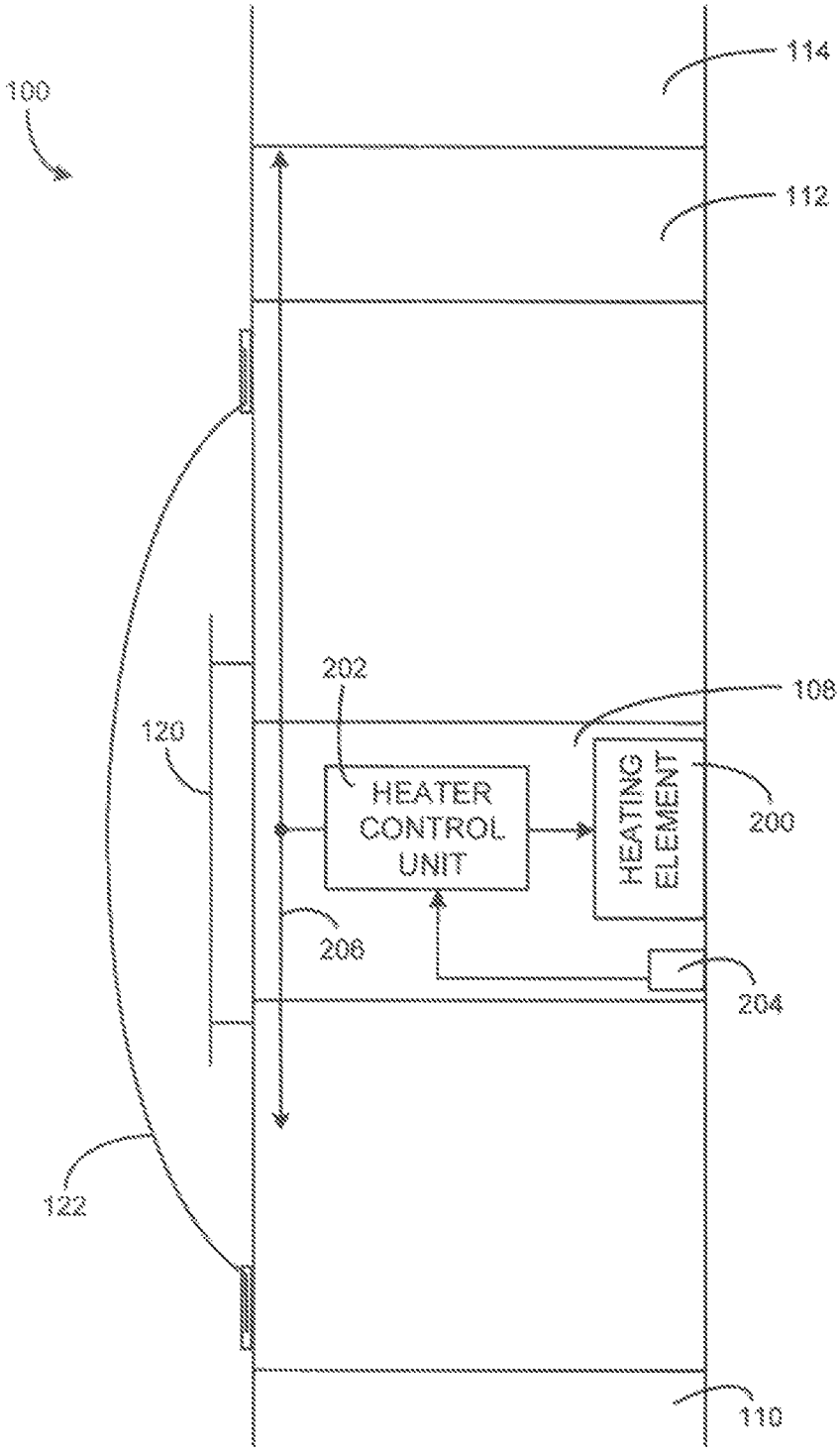
FIG. 2 is a more detailed view of the example heating tool of FIG. 1.

FIG. 2 is a more detailed view of the example heating tool 100 of FIG. 1. As shown in FIG. 2, the heating module 108 includes a heating element 200, a heater control unit 202, and a temperature sensor 204, all of which are operatively coupled to heat an area or volume of a formation (e.g., the formation F) to a desired temperature to decrease the viscosity and increase the mobility of a fluid to be sampled from the formation F. The heating element 200 may be implemented using, for example, one or more resistive wires that may, for example, be coiled about an inside or outside surface of the example tool 100 in the area of the heating module 108. The wires used to implement the heating element 200 may be similar to those used in the Hydrate Melter™ and/or the PatchFlex™ products provided by Schlumberger, Inc. Alternatively and/or additionally, the heat provided by the heating module may be produced through electrical resistivity in the formation F, RF Induction, Ultrasonic or through a chemical reaction. It is also contemplated that the hot fluid, such as steam for example, may be transferred from the surface to the module 108 in order to heat the formation F.

The temperature sensor 204 may be implemented using any suitable temperature sensing device and is mounted on the heating tool 100 to sense the temperature of the formation being heated and/or the temperature of the heating element 200. The temperature sensor 204 sends signals (e.g., a changing resistance value) to the heater control unit 202 which, in turn, controls the heat energy being generated by the heating element 200. For example, based on the signals received from the temperature sensor 204 (e.g., based on the temperature of the portion of the borehole wall 123 corresponding to the area of the formation being heated), the heater control unit 202 varies the heat energy generated by the heating element 200. In some examples, the heater control unit 202 may provide a continuously variable current or voltage to the heating element 200, may pulse modulate a substantially fixed peak current or voltage to the heating element 200, or may vary the electrical energy provided to the heating element 200 in any other manner to increase or decrease the heat energy generated by the heating element 200. By controlling the heat energy generated by the heating element 200 based on the temperature sensed by the temperature sensor 204, the heater control unit 202 can control the temperature gradient to which the formation being heated is subjected, thereby minimizing or preventing the possibility that the formation F will be compromised by thermal cracking and/or the degradation of the fluid to be sampled. The thermal conductivity of the formation F may be relatively low, which results in slow temperature propagation through the formation F. Thus, by controlling the temperature of the portion of the borehole wall 123 associated with the area of the formation F being heated, the maximum temperature gradient to which the formation F is subjected can be controlled or limited to prevent any damage (e.g., thermal cracking) to the formation F.

The heater control unit 202 and/or signals received from the electronics module 118 via signals lines 206 may cause the heater control unit 202 to heat the formation F for a predetermined amount of time. In general, a longer heating time increases the temperature of a larger volume of the formation F to a temperature that facilitates extraction of heavy oil from the formation F. In some cases, heating a formation for several hours increases the temperature of a volume of the formation by 50° C. and enables about one liter of heavy oil to be extracted. However, the amount of time required to heat a formation depends on many factors such as, for example, the properties (e.g., heat capacity, viscosity, dependence of viscosity on temperature, density, etc.) of the heavy oil to be extracted, the characteristics (e.g., heat capacity, thermal conductivity, density, thermal diffusivity, permeability, etc.) of the formation from which the heavy oil is to be extracted, the power or maximum heat energy that can be delivered by the heating module 108, the maximum safe thermal gradient to which the formation can be subjected, the size or volume of the sample desired (i.e., a larger sample may require heating a larger volume of the formation), etc. The temperature increase must be controlled so the fluid is maintained as a single phase and not permitted to extend through the bubble pressure and into the two-phase region.

Figure 3A:
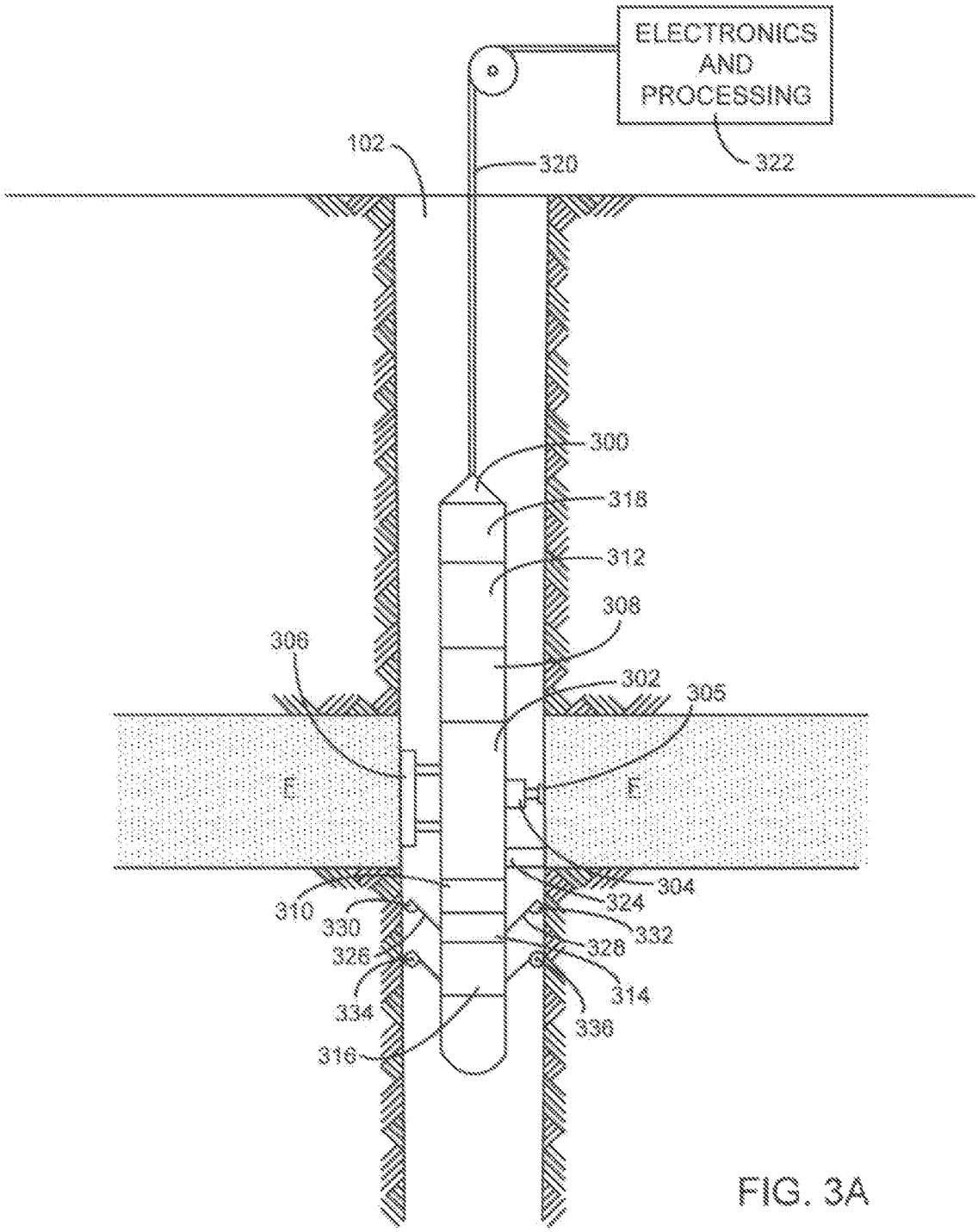
FIG. 3*a* depicts an example formation sampling tool that may be used to obtain a sample of heavy oil from a previously heated volume of a formation.

FIG. 3*a* depicts an example formation sampling tool 300 that may be used following the heating of an area or volume of the formation F to obtain a sample of heavy oil from the heated volume of the formation F. To sample fluid from the formation F, the sampling tool 300 includes a sampling module 302. The sampling module 302 includes an extendable sampling assembly 304 (shown in an extended position) having a packer or probe 305 disposed at an end thereof to extract fluid from the formation F and an extendable anchoring member 306 (shown in an extended position) to anchor the sampling tool 300 and the probe 305 in position to contact the formation F. The probe 305 is preferably the Quicksilver™ probe provided by Schlumberger, Inc. However, any other single or dual inlet (i.e., guard type) sampling probe or probes or inflatable packer sampling module could be used instead. The sampling tool 300 may also include packers 308 and 310, one or both of which may be used to hydraulically isolate a portion of the borehole 102, a position detection module 312, a borehole wall temperature detection module 314, a tool positioning module 316, and electronics 318. As depicted in FIG. 3*a*, the sampling tool 300 is suspended or deployed in the borehole 102 via a cable 320 that is coupled to an electronics and processing unit 322 on the surface. The cable 320 may include multiple cables and/or wires to provide strength to hold the weight of the tool 300 and to convey power, communication signals, command signals, etc. between the electronics and processing unit 322 and the sampling tool 300. When the formation has substantial connate water, the Quicksilver probe is preferred because the more mobile aqueous phase can be pumped through the guard (outer) probe while the less mobile oil through the inner (sample) probe.

The sampling module 302 may also include a temperature sensor 324 to detect the temperature of the wall 123 of the borehole 102. By detecting the temperature of the wall 123 of the borehole 102, the sampling tool 300 and/or the electronics and processing unit 322 can locate the portion of the formation F previously heated by the heating tool 100. In turn, once the portion of the formation F that was previously heated by the tool 100 is detected, the inlet of the sampling probe 305 can be located (e.g., by moving the sampling tool 300 slightly downward a distance equal to about the space between the temperature sensor 324 and the inlet of the sampling probe 305) against the heated portion of the formation F to extract a sample of fluid therefrom. Additionally or alternatively, the borehole wall temperature detection module 314 may include a plurality of extendable fingers, arms, or probes 326 and 328 having respective temperature sensors 330 and 332 at the ends of the arms 326 and 328 to contact the wall 123 of the borehole 102. In this manner, the extendable fingers, arms, or probes 326 and 328 can be used to determine or locate the portion of the wall 123 of the borehole 102 previously heated by the heating tool 102. Once the previously heated portion of the wall 123 of the borehole 102 is located, the tool 300 can be positioned (e.g., moved downwardly a distance equal to about the space between the inlet of the sampling probe 305 and the temperature sensors 330 and 332 and optionally rotated to position the probe opening directly opposite the heated portion of the wall) so that the inlet of the probe 305 is in contact with the portion of the borehole wall 123 previously heated by the heating tool 100. While only two extendable fingers, arms, or probes 326 and 328 are shown, six such fingers, arms, or probes are desirable. However, any other number of such fingers, arms or probes may be used instead. Examples of known tools that include multiple fingers, arms, or probes include the PMIT-B™ and PMIT-C™ multi-finger caliper tools provided by Schlumberger, Inc. While these known tools are configured to measure radial distances within a borehole, such a configuration could be modified to include temperature sensors at the end(s) of one or more of the fingers so that the temperature sensors are held in contact with the wall 123 of the borehole 102. The temperature sensors used (e.g., to implement the sensors 330 and 332) can be elements that provide a resistance that varies as a function of temperature, infrared devices, or any other suitable temperature sensing element(s).

To position the sampling tool 300 in the borehole 102, the tool positioning module 316 includes a plurality of tool positioners 334 and 336, each of which may be independently actuated or moved to cause the sampling tool 300 to rotate in the borehole 102. While two tool positioners 334 and 336 are shown in FIG. 3*a*, more or fewer such positioners could be used instead. Additionally or alternatively, the sampling tool 300 could be positioned within the borehole 102 using other or different mechanisms or techniques suitable for the geometry, deviation, and diameter of the borehole 102. For example, in boreholes having an at least somewhat oval geometry, powered calipers such as the tool positioners 334 and 336 can be used to position or orient the sampling tool 300. For boreholes having a substantially circular geometry, tool turners and/or bow springs can be employed (not shown). Bow springs are particularly useful to turn or rotate the tool 300 more than forty-five degrees. Where the diameter of the tool 300 is only slightly smaller than that of the borehole 102, the sampling tool 300 may be oriented by moving it upward and downward and thus causing small rotations of the tool 300. In the case of horizontal boreholes, the sampling tool 300 is coupled to a drill string and the Schlumberger, Inc. Tough Logging Conditions (TLC™) system may be used and the drill pipe rotated to orient the sampling tool 300.

To determine the location or position of the sampling tool 300 in the borehole 102, the position detection module 312 provides tool depth and orientation information. For example, the position detection module 312 may use magnetometers (e.g., a GPIT™ provided by Schlumberger, Inc.) to detect the orientation of the sampling tool 300 and may additionally use a gamma ray device to determine the depth of the sampling tool 300. The position detection module 312 may continuously or periodically communicate tool position or location information via communication circuitry in the electronics module 318 and the cable 320 to the electronics and processing unit 322 on the surface. In this manner, an operator or other person on the surface can monitor the position or location of the sampling tool 300 to determine when the inlet of the sampling probe 305 is aligned with the portion of the formation F that was previously heated by the heating tool 100. Alternatively or additionally, the tool position or location information may be used by the electronics and processing unit 322 to automatically adjust the depth and/or orientation of the sampling tool 300 to align the inlet of the sampling probe 305 with the previously heated portion of the formation F. Alternatively or additionally, the electronics processing unit 322 may be a module of the downhole tool, and it may include algorithms and methods to adjust the depth and/or orientation of the sampling tool 300 to align the inlet of the sampling probe 305 with the previously heated portion of the formation, without need to communicate to the surface, or communicate to a person or operator at the surface.

Figure 3B:
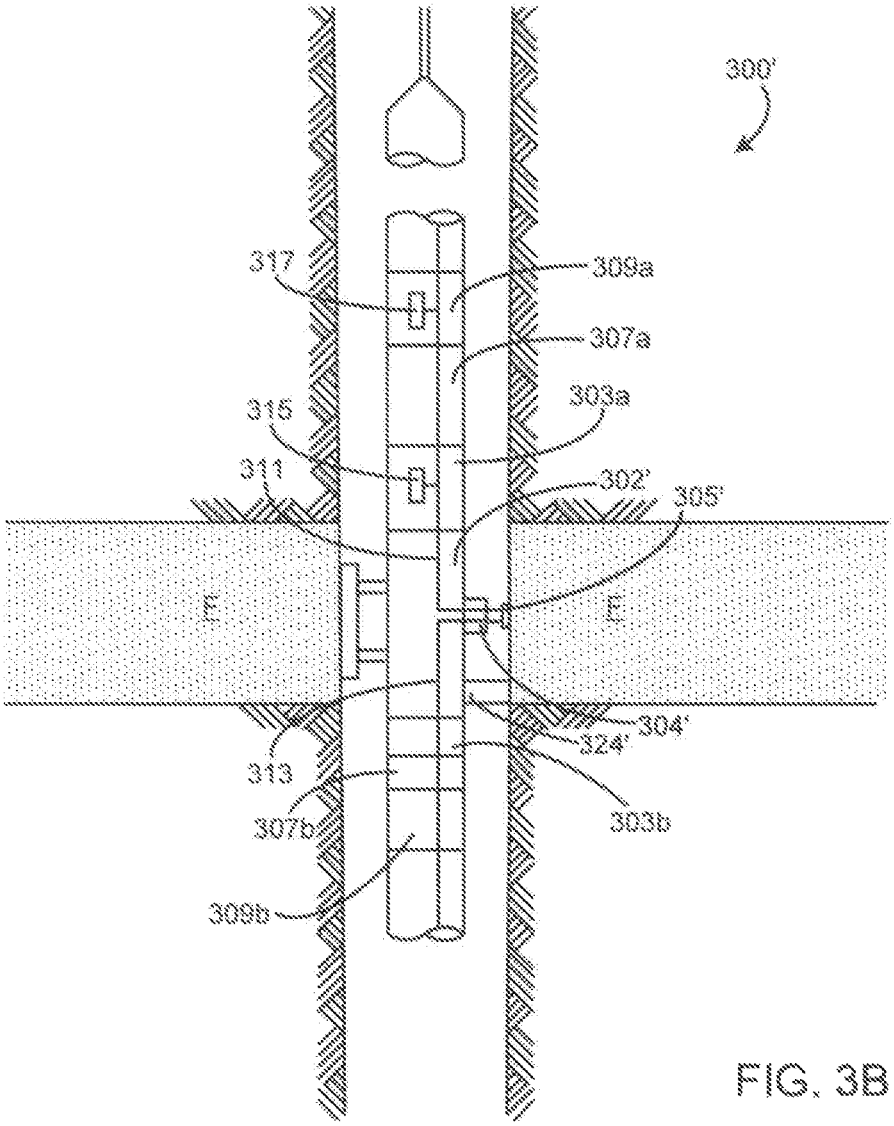
FIG. 3*b* depicts an another example formation sampling tool that may be used to obtain a sample of heavy oil from a previously heated volume of a formation.

FIG. 3*b* depicts another example formation sampling tool 300' that may be used following the heating of an area or volume of the formation F to obtain a sample of heavy oil from the heated volume of the formation F. To sample fluid from the formation F, the sampling tool 300' includes a sampling or probe module 302'. The sampling module 302' includes an extendable sampling assembly 304' and a probe 305'. The probe 305' is a multi inlet or guard probe, such as the Quicksilver™ probe provided by Schlumberger, Inc. However, the multiple inlets may be disposed over a number of packers or probes. The sampling tool 300' may also include a position detection module, a borehole wall temperature detection module, a tool positioning module, electronics (not shown), and a temperature sensor 324', which may operate similar to the corresponding modules in sampling tool 300. In addition, the tool 300' may further include any features and assemblies found in the tool 300.

Shown more clearly in FIG. 3*b*, the tool 300' (and 300) may include one or more pumpout modules 309, one or more sample bottle carrier modules 303, and one or more downhole fluid analysis (DFA) modules 307. In particular, the sample module 302' includes a first flowline 311 and a second flowline 313 fluidly coupled to an exterior of the tool. As illustrated in FIG. 3*b*, the flowlines 311, 313 are each coupled to the probe 305', with the first flowline 311 being positioned and adapted to receive virgin formation fluid and the second flowline 313 being positioned and adapted to receive contaminated formation fluid or water. Alternatively, the first flowline 311 may receive contaminated fluid and the second flowline 313 may received virgin formation fluid or the first and the second flowlines 311, 313 may receive the same or combinations of fluids. Disposed to either side of the sample module 302' may be a sample bottle carrier modules 303, with the module 303*a* being disposed to a top of the sample module 302' and the module 303*b* being disposed to a bottom of the sample module 302'. A pair of (DFA) modules 307*a* and 307*b* may then be disposed to either side of the sample bottle carrier modules 303*a* and 303*b*, respectively, followed by a pair of pumpout modules 309*a* and 309*b* disposed to either side of the DFA modules 307*a* and 307*b*, respectively. As such, the flowlines 311, 313 may be located in each of the modules to enable a fluid connection to the various modules and the assemblies located therein.

In this configuration, the tool 300' can be configured to handle a multiple flowline configuration and, as will be discussed in more detail below, the warming of the flowline 311 and/or the flowline 313. For example, formation fluid may be traversed through the first flowline 311 into the sample bottle carrier module 303*a*, where the formation fluid may be stored in one or more sample bottles 315 utilizing a valve system (not shown). The formation fluid may then enter the DFA module 307*a* where a determination about the formation fluid can be made. For example, the DFA modules 307 may include one or more fluid sensors, including but not limited to a pressure sensor, an optical sensor, a viscosity sensor, a density sensor, a resistively sensor and a $H_2O$, for determining various fluid parameters. To provide movement of the formation fluids into and through the various modules the pump-out unit 309*a*, having a pump 317 fluidly coupled to the flowline 311, may be disposed next to the DFA module 307*a*.

This configuration provides several advantages. For example, as the sample bottle carrier module 303*a* is disposed adjacent or nearest the prone module 302', the formation fluid traversing through the tool 300' and specifically thought the flowline 311 only travels a short distance before entering the sample bottle(s) 315. Thus, if the formation fluid and/or the flowline 311 requires heating in order to lower the viscosity of the formation fluid sufficiently to ensure flow through the flowline 311, the heating period and/or heating distance is greatly reduced.

The heating of the flowline 311 may be accomplished in several manners, some of which will be discussed in more detail below. In this configuration, however, heated fluid, such as $H_2O$ for example, may be carried, heated and/or stored in the bottle(s) 315 in the carrier module 303*a*, thus enabling the flowline 311 to be flushed with the heated fluid, thereby pre-heating or heating the flowline to permit the sampling of high viscosity fluid. The second flowline 313 may be set-up or configured relative to the modules in a substantially similar manner as described above with respect to flowline 311.

Figure 4:
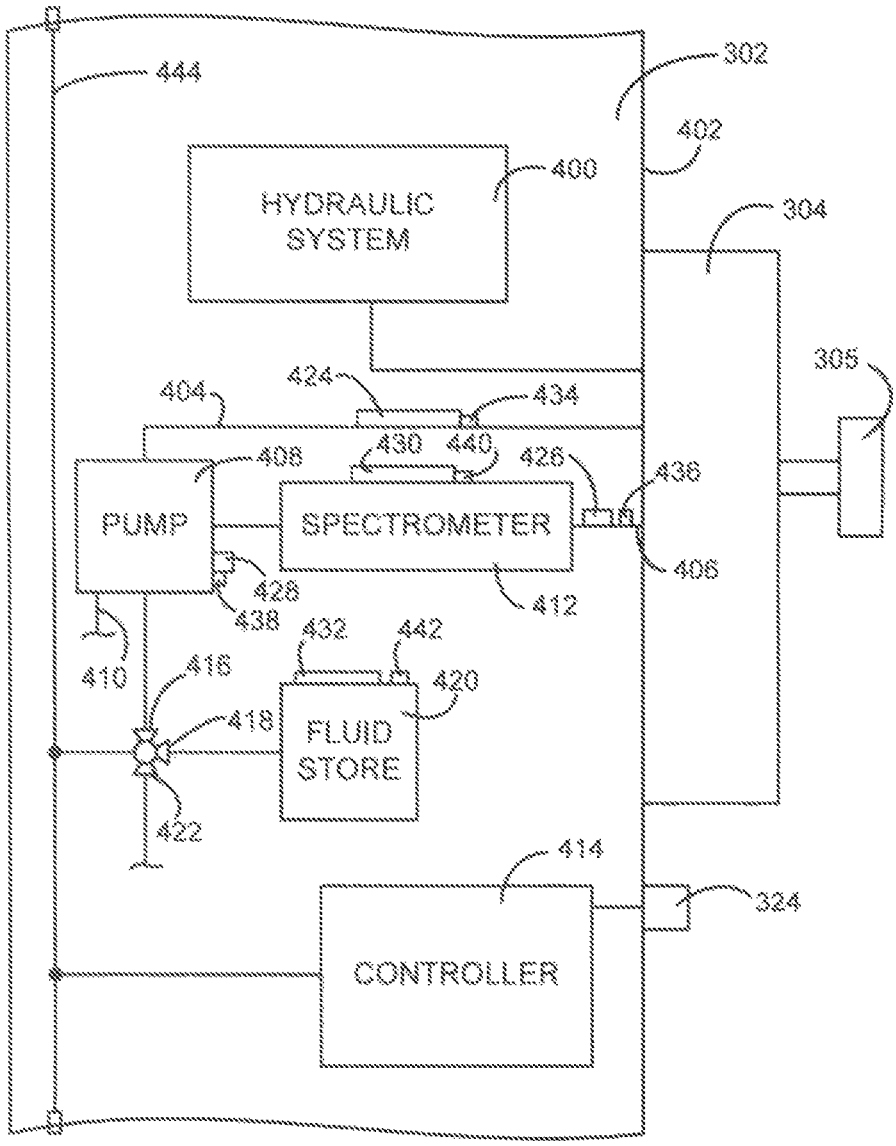
FIG. 4 depicts in greater detail the example sampling module shown in FIG. 3*a*.

It is worthy to note that the some of the modules and/or features described in FIG. 3*b* may be duplicative of modules and/or features described in FIG. 4, each having different identifiers. This was done to ensure clarity of the application. However, one of ordinary skill in the art would understand how the modules and/or features described in FIGS. 3*a*-4 would interact and operate.

FIG. 4 depicts in greater detail the example sampling module 302 shown in FIG. 3. As shown in FIG. 4, the sampling module 302 includes a hydraulic system 400 that may be fluidly coupled to the sampling probe assembly 304 to selectively extend the sampling probe 305 into engagement with the formation F to enable a sample of fluid to flow into the sampling probe 305. Additionally, the hydraulic system 400 may also selectively retract the sampling probe assembly 304 toward or into a chassis or body 402 of the sampling module 302 when the sampling operation is completed. As noted above, the sampling probe 305 is preferably a guard type probe (e.g., the Quicksilver™ probe provided by Schlumberger, Inc.) having a guard flowline 404 and a sample flowline 406.

A pump or pumpout 408 draws fluid (e.g., from the formation F) through the guard and sample flowlines 404 and 406 in a manner that results in a more rapid sampling of a substantially contamination free formation fluid. In particular, the pumpout 408 discards formation fluid from the guard flowline 404 to a flowline 410 that exits the body 402 of the sampling module 302 (e.g., fluid in the flowline 410 may be passed to the annulus surrounding the sampling tool 300 in the borehole 102). At the same time the pumpout 408 is drawing fluid through the guard flowline 404 and discarding that fluid via the line 410, the pumpout 408 draws fluid through a spectrometer 412 that is positioned on the sample flowline 406. The sampling tool 300 may of course include more than one pumpout 408 to facilitate various sampling configurations, such as one having a plurality of inlets for example. The spectrometer 412 monitors the contamination level(s) of (e.g., the amount of drilling fluid or filtrate within) the formation fluid flowing in the sample flowline 406 and communicates information relating to the contamination level(s) to a controller 414. The spectrometer 412 may be implemented using the Live Fluid Analyzer™ (LFA) provided by Schlumberger, Inc. or any other spectrometer or device capable or detecting the contamination of a formation fluid sample. The pumpout 408 conveys fluid drawn through the spectrometer 412 via the sample flowline 406 to a valve 416, which has a first selectable outlet 418 that is fluidly coupled to a fluid store 420 and a second selectable outlet 422 that passes fluid out of the sampling module 302 (e.g., to the annulus) between the borehole wall 123 and the sampling tool 300.

The guard flowline 404, sample flowline 406, the pumpout 408, the spectrometer 412 and/or the fluid store 420 may have respective heating elements 424, 426, 428, 430, and 432 to maintain the temperature of heavy oil drawn in by the probe assembly 304 sufficiently high to ensure that the heavy oil remains sufficiently mobile within the sampling module 302 and its internal components. However, while one or more such separate heating elements (e.g., the heating elements 424, 426, 428, 430, and 432 are shown in FIG. 4, fewer such elements or a single larger heating element (e.g., encompassing a portion or all of the body 402 of the sampling module 302) could be used instead. The heating elements 424, 426, 428, 430, and 432 may also include respective temperature sensors 434, 436, 438, 440, and 442 to monitor and control the temperature of the flowlines 404 and 406, the pumpout 408, the spectrometer 412, and the fluid store 420 to ensure that the formation fluid within these components remains sufficiently mobile (i.e., the viscosity remains sufficiently low).

The controller 414 is operatively coupled to the hydraulic system 400, the pumpout 408, the spectrometer 412, the valve 416, and/or the fluid store 420 via wires or lines 444. The wires or lines 444 may include a databus (e.g., carrying digital information and/or analog information), power signals, etc. and may be implemented using a single conductor or multiple conductors. Additionally, the controller 414 receives temperature signals from the temperature sensor 324.

In operation, the controller 414 may use the temperature information received from the temperature sensor 324 to detect the location of the formation F that was previously heated by the heating tool 100 to enable the sampling module 302 to be located at a depth and orientation such that the sampling probe 305 is aligned with the previously heated location of the formation F. Once located, the controller 414 may control the hydraulic system 400 to extend the sampling probe assembly 304 to engage or contact the borehole wall 123 to fluidly couple the probe 305 to the formation F. The controller 414 may then control the pumpout 408 to draw fluid through the guard flowline 404 and the sample flowline 406 while monitoring the contamination level of the fluid in the sample flowline 406 via the spectrometer 412. Initially, fluid drawn into the guard and sample flowlines 404 and 406 is discarded (e.g., conveyed to the annulus). Thus, the controller 414 initially controls the valve 416 to route fluid in the sample flowline 406 to the annulus so that the fluid in the sample flowline 406 is not stored in the fluid store 420. As the pumpout 408 continues to draw fluid from the formation F through the sampling probe 305, the level of contamination (e.g., the amount of filtrate) in the fluid passing through the sample flowline 406 decreases. When the controller 414 determines via the spectrometer 412 that the formation fluid in the sample flowline 406 is substantially free of contamination (e.g., substantially free of filtrate) and/or has reached an acceptably low level of contamination, the controller 414 causes the valve 416 to route fluid from the sample flowline 406 to the fluid store 420. When a sufficient quantity of sample fluid has been transferred to the fluid store 420, the controller 414 may terminate the sampling process by deactivating the pumpout 408 and retracting the sampling probe assembly 304.

During the sampling process, the pumpout 408 may be operated to control the flow rates and/or pumping rates in the guard and sample flowlines 404 and 406 to achieve a relatively rapid reduction in the contamination level of the fluid in the sample flowline 406. Further, the controller 414 may also control the absolute and relative pumping rates of the fluid in the guard and sample flowlines 406 and 408 to prevent pressure drops that could reduce the pressure of the formation fluid below its bubble pressure, result in the formation of emulsions, and/or collapse the formation F. For example, the controller 414 may operate the pumpout 408 so that its internal pumps are cycled on/off, operated for single strokes, or in any other manner to prevent an excessive pressure drop.

While the example of FIGS. 3 and 4 depicts the sampling probe 305 as a dual inlet or guard probe, a single inlet probe (e.g., the extra large diameter (XLD) probe provided by Schlumberger, Inc.) could be used instead. However, the use of a dual inlet or guard probe (e.g., the Quicksilver™ probe provided by Schlumberger, Inc.) typically enables a relatively rapid reduction in sample fluid contamination and, thus, typically reduces sampling times, which is particularly useful in the examples described herein because the viscosity of the heavy oil in the formation F will tend to increase over time following the removal of the heating tool 100. As a result, decreasing the time required to draw sample fluid from the formation F enables the sample fluid to be extracted while it remains at a relatively higher temperature, lower viscosity, and higher mobility within the formation F. Additionally, drawing the sample fluid while it exhibits a relatively lower viscosity and higher mobility may facilitate the ability of the controller 414 to maintain the pressure drops associated with the sampled fluid in an acceptable range.

Figure 5:
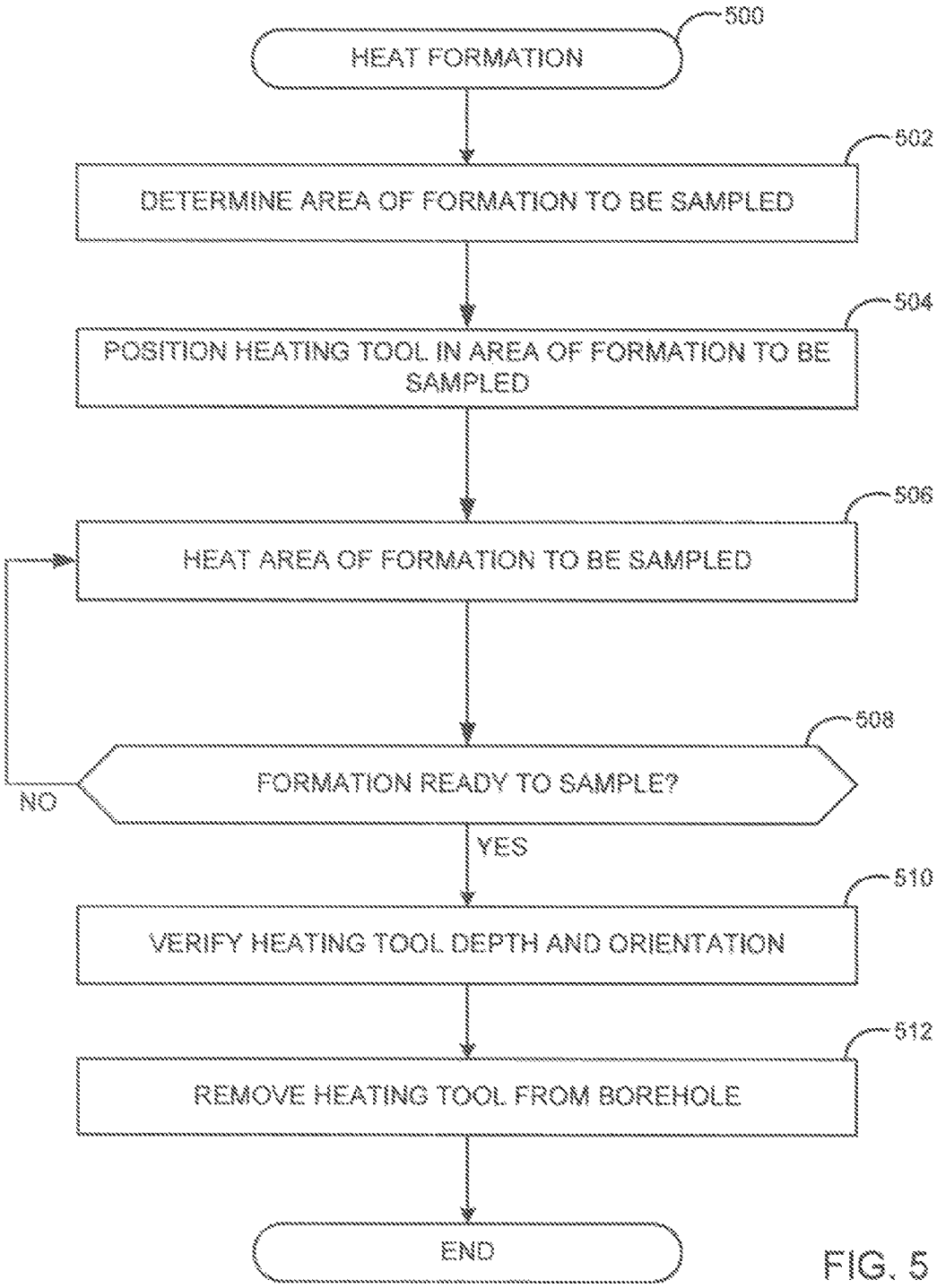
FIG. 5 is a flow diagram that depicts an example method that may be used to heat a subterranean formation.
Figure 6:
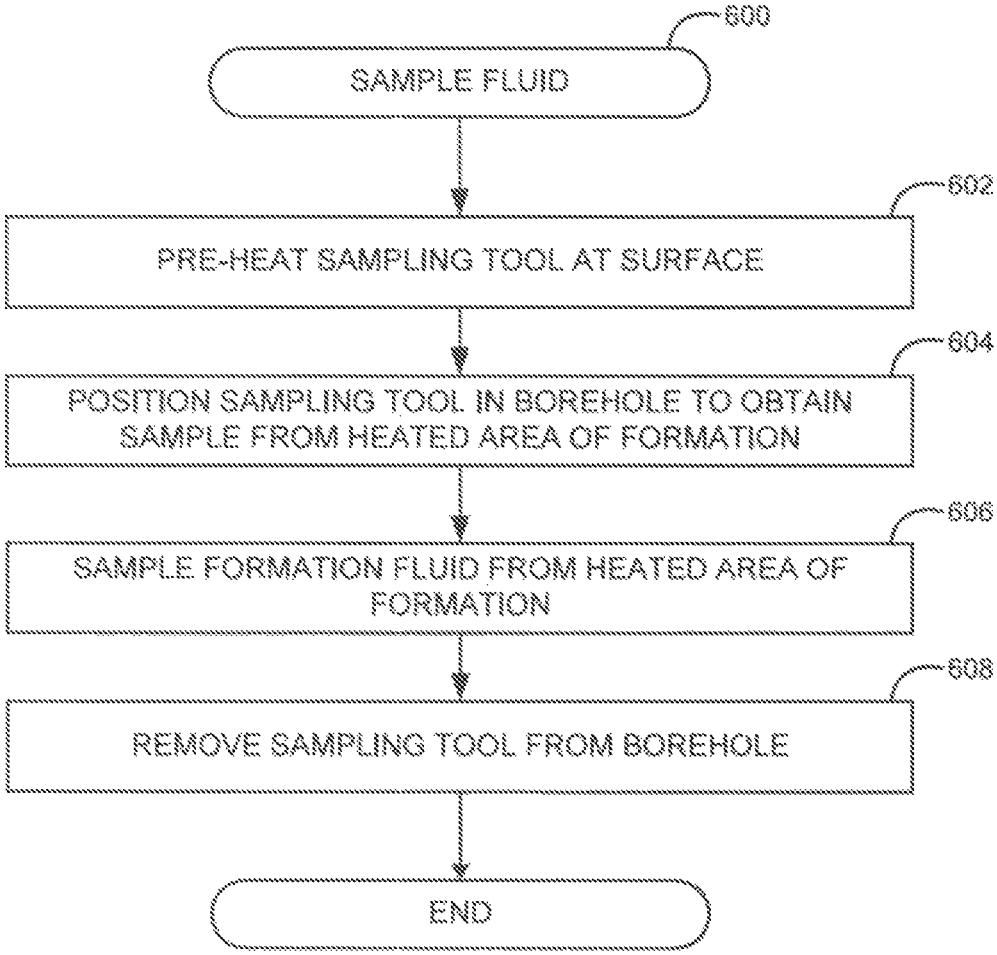
FIG. 6 is a flow diagram that depicts an example method to sample formation fluid from a previously heated area of a subterranean formation.

FIGS. 5 and 6 are flowcharts of example methods that can be used to sample heavy oil from a subterranean formation (e.g., the formation F). The example methods of FIGS. 5 and 6 may be implemented using software and/or hardware. In some example implementations, the flowcharts can be representative of example machine readable instructions and the example methods of the flowcharts may be implemented entirely or in part by executing the machine readable instructions. Such machine readable instructions may be executed by one or more of the electronics and processing units 106 (FIG. 1) and 322 (FIG. 3), the heater control unit 202, and/or the controller 414. In particular, a processor or other suitable device to execute machine readable instructions may retrieve such instructions from a memory device (e.g., a random access memory (RAM), read only memory (ROM), etc.) and execute those instructions. In some examples, the one or more of the operations depicted in the flowcharts of FIGS. 5 and 6 may be implemented manually. Further, the order of execution of the blocks depicted in the flowcharts of FIGS. 5 and 6 may be changed, and/or some of the blocks described may be rearranged, eliminated, or combined.

FIG. 5 is a flow diagram depicting an example method 500 that may be used to heat a subterranean formation (e.g., the formation F). Initially, the method 500 determines an area of a formation (e.g., the formation F) to be sampled (block 502). For example, a formation logging tool (e.g., having a gamma-ray based device) may be run into the borehole (e.g., the borehole 102) to determine the depth of the formation to be sampled. A formation heating tool (e.g., the heating tool 100) is then positioned within the borehole (e.g., the borehole 102) relative to the area of the formation (e.g., the formation F) to be sampled (block 504). For example, to position the heating tool 100 within the borehole 102, the heating tool 100 may be lowered to a depth (e.g., based on a depth determined at block 502) such that the heating module 108 is adjacent to or aligned with the formation F. The depth of the heating module 108 may be determined using any known technique such as, for example, cable flagging of the cable 104. Additionally, the position detector 116 may be used to determine the orientation of the tool 100 relative to the formation F to determine the portion or area of the formation F that is in contact with the heating module 108.

The area of the formation to be sampled is then heated (block 506). For example, the heater control unit 202 (FIG. 2) may apply electrical power to the heating element 200 (FIG. 2) based on the temperature of the borehole wall 123 in the area of the formation F as provided by the temperature sensor 204 (FIG. 2). The temperature of the borehole wall may be controlled to a desired elevated temperature (e.g., 50° C. above reservoir conditions) and maintained at the elevated temperature. The selected or controlled elevated temperature maintained by the heating module 108 is selected to minimize or substantially prevent the possibility of causing thermal cracking of the fluids in formation F or otherwise compromising the integrity of the formation F and the integrity of the formation fluids in formation F. However, the selection of an appropriate elevated temperature may be based on numerous factors such as, for example, the geophysical properties of the formation, the properties of the heavy oil in the formation F, etc.

The method 500 continues to heat the formation F until the formation F is ready to sample (block 508). The formation F may be heated for a predetermined amount of time that heats a volume of the formation F sufficiently to provide a desired volume of sample fluid. For example, several hours may be required to sufficiently heat a volume of a formation to facilitate the extraction of about a one liter sample of heavy oil. After the method 500 determines that the formation F is ready to be sampled (block 508), the method 500 verifies the position (e.g., the depth and orientation) of the sampling tool 100 within the borehole 102 (block 510). Such verified position information may be stored for subsequent reference during sampling of the formation F. After verifying the position of the sampling tool 100 within the borehole 102, the sampling tool 100 is removed from the borehole 102 (block 512).

FIG. 6 depicts an example method 600 to sample formation fluid from a previously heated area of a subterranean formation. Initially, the sampling tool (e.g., the sampling tool 300) is pre-heated on the surface of the earth (block 602). Alternatively, the sample tool may be heated in the borehole. For example, the sampling tool 300 may be heated to at least the temperature of the heating module 108 using a tool oven, heating blankets, and/or by winding insulated resistive elements around the tool 300. Heating the sampling tool 300 to a temperature of about that to which the area of the formation F to be sampled has been heated that, but which does not exceed the maximum operating temperature of the tool 300, reduces the potential cooling effect that the tool 300 could have when brought into proximity or contact with the previously heated portion of the formation F. Additionally, preheating the sampling tool 300 facilitates the flow of sampled formation fluid within the sampling tool 300 by maintaining the temperature of the sampled fluid at a relatively high temperature and, thus, low viscosity.

The pre-heated sampling tool 300 is then positioned in the borehole 102 to obtain a sample of formation fluid from the area of the formation F that was previously heated by the heating tool 100 (block 604). The sampling tool 300 is positioned in the borehole 102 by placing the sampling tool 300 at a depth and orientation such that the sampling probe 305 is aligned with and enabled to fluidly couple to the area of the formation F that was previously heated by the heating module 108 of the heating tool 100. As described above in connection with FIG. 3, the position detector 312, the temperature sensor 324, the temperature detection module 314, and/or the tool positioning module 316 may be used to position the sampling tool 300 so that the sampling probe 305 is properly aligned with the previously heated portion of the formation F.

When the sampling tool 300 is properly positioned within the borehole 102 the example method 600 samples the formation fluid from the formation F (block 606). The sampling tool 300 may sample the fluid from the formation F as described above in connection with FIG. 4. After the example method 600 completes the sampling (block 606), the sampling tool 300 is removed to the surface (block 608).

While the foregoing examples describe example heating and sampling tools as being implemented as wireline devices, any other manner of deploying tools in boreholes could be used instead. For example, drill pipe and/or coiled tubing may be used to deploy one or both of the example heating and sampling tools described herein to achieve similar or identical results. Further, while the examples described herein are depicted in use with an uncased borehole, the example methods and apparatus described herein could also be employed in cased boreholes.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. An apparatus, comprising:

a first tool comprising a heating module and a heating control unit, wherein the heating module is configured to convey heat energy to a portion of a subterranean formation, wherein the heating control unit is configured to control the heat energy provided by the heating module to the portion of the subterranean formation and further wherein the first tool obtains data relating to a location of or a position of the portion; and a second tool comprising a sampling inlet and an orientation module, wherein the orientation module is configured to orient the sampling inlet relative to the portion of the subterranean formation using the data.

2. The apparatus of claim 1 wherein the first tool further comprises a heat reflector adjacent to the heating module and configured to reflect at least some of the heat energy provided by the heating module toward a wall of the borehole.

3. The apparatus of claim 1 wherein the second tool further comprises a temperature sensor configured to sense a temperature of a wall of the borehole to identify the portion of the subterranean formation.

4. The apparatus of claim 1 wherein the first and second tools are each configured to be deployed in the borehole via a single wireline, a single drill string, or a single coiled tubing string.

5. The apparatus of claim 1 wherein the data comprises a depth and an azimuth.

6. The apparatus of claim 1 wherein the data is stored in the first tool and further wherein the first tool is in communication with the second tool.

7. The apparatus of claim 1 wherein the data is transmitted to the Earth's surface and further wherein the second tool communicates with the Earth's surface and utilizes the data to orient the sampling inlet.

8. An apparatus, comprising:

a downhole apparatus, comprising:

a first tool comprising a heating module and a heating control unit, wherein the heating module is configured to convey heat energy to a portion of a subterranean formation, and wherein the heating control unit is configured to control the heat energy provided by the heating module to the portion of the subterranean formation;

a second tool comprising a sampling inlet, an orientation module, and at least one of a packer and a probe, wherein the orientation module is configured to orient the sampling inlet relative to the portion of the subterranean formation, and wherein the at least one of a packer and a probe is configured to isolate at least a section of a portion of the borehole; and wherein the first tool further comprises a heat reflector adjacent to the heating module and configured to reflect at least some of the heat energy provided by the heating module toward a wall of the borehole.

9. The apparatus of claim 8 wherein the second tool is heated.

10. The apparatus of claim 8 wherein the second tool further comprises a temperature sensor configured to sense a temperature of a wall of the borehole to identify the portion of the subterranean formation.

11. The apparatus of claim 8 wherein the first tool and the second tool are deployed into the well together.

* * * * *